US005536151A

United States Patent [19]

von Eckardstein

[11] Patent Number: 5,536,151

[45] Date of Patent: Jul. 16, 1996

[54] DEVICE FOR THE PNEUMATIC DISCHARGE OF CONCRETE THAT IS HYDROMECHANICALLY TRANSPORTED IN A DENSE FLOW

[75] Inventor: Karl-Ernst von Eckardstein, Unna, Germany

[73] Assignee: Friedrich Wilh. Schwing GmbH, Herne, Germany

[21] Appl. No.: 17,572

[22] Filed: Feb. 16, 1993

[30] Foreign Application Priority Data

Feb. 20, 1992 [DE] Germany ..... 42 05 144.4

[51] Int. Cl.[6] ..... F04Q 9/10

[52] U.S. Cl. ..... 417/429; 417/900; 222/137

[58] Field of Search ..... 417/429, 900; 222/137, 275, 276

[56] References Cited

U.S. PATENT DOCUMENTS

| | | | |
|---|---|---|---|
| 2,925,780 | 2/1960 | Tear | 417/429 X |
| 3,814,289 | 6/1974 | Robbins | 222/275 X |
| 3,951,311 | 4/1976 | Johansson . | |
| 4,231,723 | 11/1980 | Spühl | 417/429 |
| 5,066,203 | 11/1991 | Coja et al. . | |

FOREIGN PATENT DOCUMENTS

| | | | |
|---|---|---|---|
| 0421378 | 4/1991 | European Pat. Off. . | |
| 120199 | 5/1901 | Germany | 417/429 |
| 2028058 | 12/1971 | Germany . | |

*Primary Examiner*—Richard E. Gluck
*Attorney, Agent, or Firm*—Kinney & Lange

[57] ABSTRACT

The invention covers a device for the pneumatic delivery of concrete that is hydromechanically transported in an enclosed stream (2) with a concrete pump (1) for the hydromechanical transport, and a solidification accelerator dosing device. In order to provide a device that allows the simultaneous metered addition of several additives, which in each case are adjustable from a minimum to a maximum volume, it is provided that at least one additional additive dosing device (500, 501, 502) with a linear piston pump (470, 471, 472) is included, that is also connected to the linear piston drive (34–37) of the device, where in the discharge lines (480, 481, 482) of each additional dosing device (500, 501, 502) a distribution valve (490, 491, 492) for the redirection of the dosing agent into each one dosing agent tank (460, 461, 462) or into the dosing agent discharge line (8, 81, 82) is installed, where the distribution valves (490, 491, 492) are loaded with the pressure of the hydraulic medium prevailing in the piston cavity of the working cylinders (25, 26).

20 Claims, 3 Drawing Sheets

DEVICE FOR THE PNEUMATIC DISCHARGE OF CONCRETE THAT IS HYDROMECHANICALLY TRANSPORTED IN A DENSE FLOW

BACKGROUND OF THE INVENTION

The invention pertains to a facility for the pneumatic manufacture/discharge of concrete that is hydromechanically transported in a dense flow.

Such a device is already known from U.S. Pat. No. 5,066,203. The discharge device described there is provided with a concrete pump for the hydromechanical transport, that is operated with a hydraulic drive of at least two opposed pistons. The Pump is synchronized (controlled to deliver a constant flow) by a displacement circuit. Additionally, the known device contains a dosing device for a solidification accelerator. The drive of the dosing device is installed in the hydraulic circuit of the pump drive and designed as a linear piston drive. The intake volume of the linear piston drive corresponds to the displacement volume of the working piston of the displacement circuit. A linear piston pump serves as the dosing device, where the linear piston drive and the linear piston pump are connected with each other and a slide is provided at the connection of drive and pump. In addition, a distributing valve for the redirection control of the solidification accelerator flow is installed in the discharge line of the dosing device to a solidification accelerator tank or into the additive discharge line, where the valve is subjected to the prevailing pressure of the hydraulic medium in the piston cavity of the working cylinder.

The known device with the solidification accelerator dosing device delivers already good results in practical application in the discharge of concrete. With the aid of the slide between linear piston drive and linear piston pump, the ratio between the volumes of the solidification accelerator and the concrete flow volume may be adjusted in a range from a minimum to a maximum value.

However, it was found that it occurs frequently in applications that, for various reasons, in addition to the solidification accelerator simultaneously another additive or dosing agent must be added to the concrete to be generated, and that it is necessary to add the solidification accelerator, and also other additives or dosing agents, in a range from a minimum to a maximum amount.

SUMMARY OF THE INVENTION

It is the objective of the invention to improve the known device further, so that also other additives may be added to the concrete flow volumes in the individually prescribed or desired ratios.

In accordance with the invention, it is provided that at least one additional additive dosing device with a linear piston pump is provided, that is also connected to the linear piston drive. In the discharge line of each further dosing device, a distributing valve is installed for the redirection control of the additional solidification accelerator or additive flow to an additive reservoir or into an additive discharge line for each. These valves, too, are subjected to the prevailing pressure of the hydraulic medium in the piston cavity of the working cylinders.

The device according to the invention offers the advantage that now a multitude of additional dosing devices are provided, so that depending on the respective requirements, various additive or dosing agents may be simultaneously added in the spraying of concrete. Since the linear piston pumps of the additional dosing devices are also connected to the linear piston drive, the individual additives or dosing agents are thereby controlled in dependency on the flow volume of the discharged concrete. If no concrete is being discharged or generated, the dosing agent or additive is directed back to the respective dosing agent reservoir. Since each dosing device possesses a designated dosing agent reservoir, no intermixing of the individual dosing agents does occur when no concrete is being discharged.

In practice, it was found that it is particularly useful to have each dosing device connected through a dedicated separate line to the spray nozzle. This design does offer itself in particular, since various dosing agents do often react with each other within a short reaction time and, e.g., precipitate in a common discharge line and such may clog it. To avoid such chemical reactions between the individual additives, and to achieve the desired effect of each individual additive, the described feature is advantageously provided.

However, it may also be advantageous in various applications to combine various dosing agents prior to feeding them to the spray nozzle, since a particular reaction is desirable and the Reaction between these additives does not proceed immediately. To achieve such reactions of two additives, it is provided that the individual feed lines are connectible with each other. The desired reaction may here occur in the joint additive feed line.

To form the connection between the linear piston drive and the additional dosing devices in a simple manner, a provision is made to connect a rocker linkage to the linear piston drive, with which the additional dosing devices are connected. Thereby all dosing devices can be controlled in a simple manner in dependency on the piston stroke of the linear piston drive and, hence, in dependency on the flow volume of the discharged concrete.

The connection between the linear piston drive and the rocker linkage may be realized in a simple way, such that the piston of the additional linear piston pump is connected through a pivoting joint with a crank rocker, which again is connected with the rocker of the linear piston drive. In this way, a simple mechanical control of all dosing devices is possible.

To be able to control each of the additional dosing devices between a minimum to a maximum value, which may be required in certain cases, since not always all additives are required, a movable slide is provided along the crank rocker of the additional dosing devices, which is connected with the linear piston drive of the additional dosing device.

However, in order to be able to adjust the dose quantity of the additional dosing device not only to a certain minimal value, but also to zero, a guide is provided for the slide which with one of its ends is connected to the frame-fixed link point of the crank rocker. This allows movement of the slide to the link point of the crank rocker, so that an excursion due to the back-and-forth movement of the linear piston drive no longer occurs, which is equivalent to the stoppage of the discharge of dosing agent. Through this special arrangement, it becomes now possible, depending on the demanded requirements of the concrete quality to, e.g., not add one additive at all, another only in a small amount, and a third at a maximum value (amount). It may also be provided to not add any of the additives, which may also be the case in certain types of application.

A simple execution of the inventive mechanical connection of the dosing devices with the linear piston drive consists of the rocker having the form of a long rod or such like. In such a design, each crank rocker of the additional dosing devices is hinged at the long rocker of the linear piston drive.

In another form of execution, it is provided that the crank rockers of the additional dosing devices are constructed in the form of a common switch. In this, the rocker of the linear piston drive is then connected with the switch, so that a back-and-forth movement occurs this way.

Further features, advantages and potential applications of the invention in question result from the examples of execution on hand of the drawing and the drawing itself.

DETAILED DESCRIPTION OF THE PREFERRED EMBODIMENTS

Figure 1:
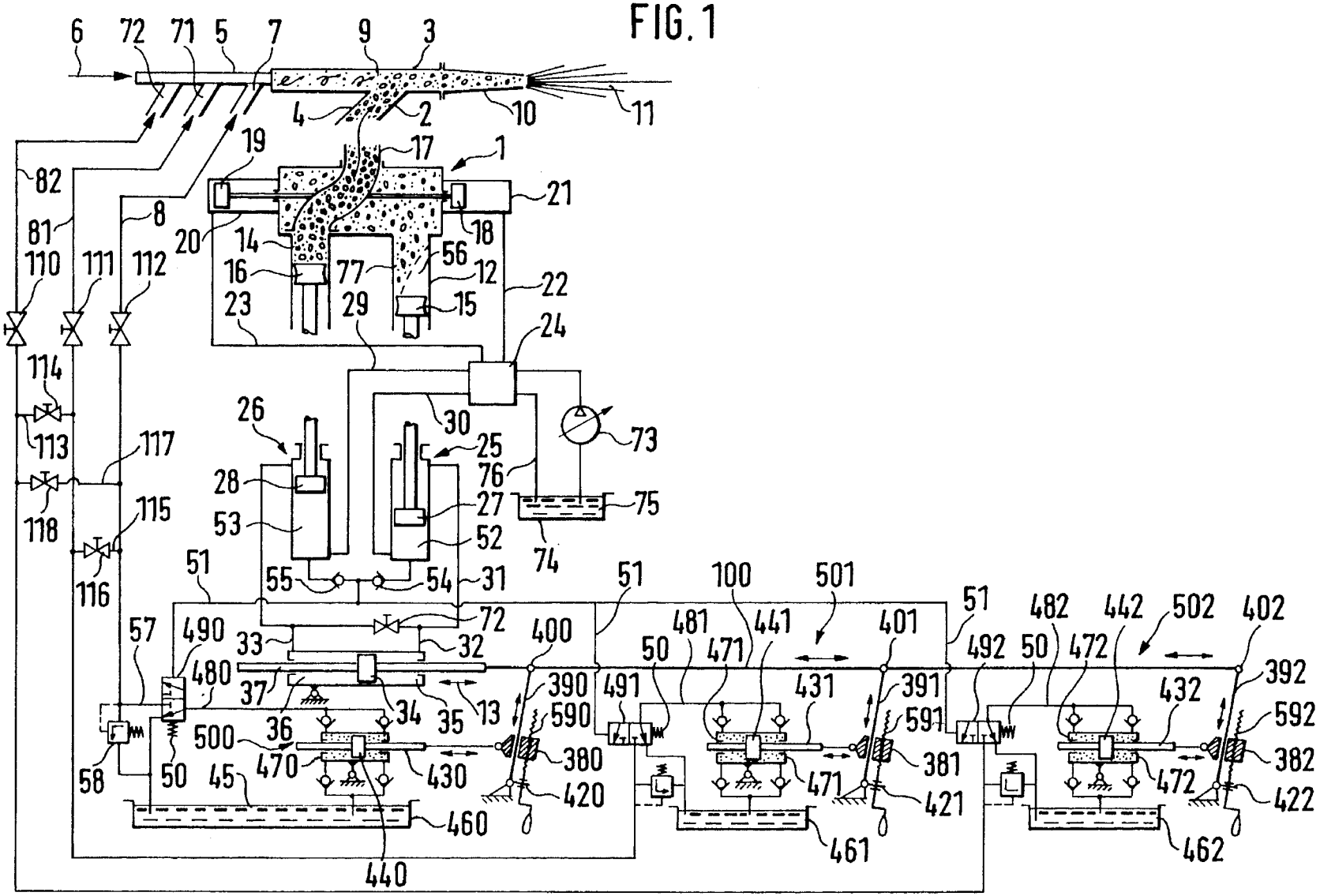
FIG. 1 is a schematic illustration of a first form of execution of the invention, in which the concrete pump, the spray device and the inventive dosing devices are depicted.

The first form of execution of the invention shown in FIG. 1, except for the dosing devices, corresponds to a concrete spray machine known from U.S. Pat. No. 5,066,203. However, to elucidate the object of invention, reference is being made once more in the following to the individual elements and their function.

The concrete pump 1, shown in FIG. 1 only in its essential parts, delivers concrete 2 in a dense flow into a nozzle pipe 3, through a hose connection 4. The nozzle pipe 3 penetrates a pipe cover and terminates at a nozzle 5. Compressed air is injected into the direction of the arrow 6 and carries various additives with it. In the present case, three additives are provided for; obviously, more than three additives may be injected. The additives reach the nozzle 5 through fittings 7, 71, and 72 from the respective lines 8, 81, and 82, where the line 8 feeds corresponding dosing agent or additive to fitting 7, line 81 to fitting 71, and line 82 to fitting 72. The dosing agents and additives sprayed by the nozzle are being suspended in the transporting air stream as they contact the dense flow of the concrete 2 at 9, which is thereby broken apart and exits under pressure from nozzle 10 of the pipe 3 in a fragmented stream 11.

The concrete pump 1 transfers the concrete with two feed cylinders 12, 14, with the aid of two pistons 15, 16, that alternately suck in the concrete and push it out through a pivoting pipe. In the example of FIG. 1, the piston 15 sucks in, while the piston 16 pushes out. The pivoting pipe 17 connects the two cylinders 12 and 14 with the feed line 4 and is always redirected at the terminal position of the pistons. This occurs hydraulically with pistons 18, 19 in the working cylinders 20, 21, which are loaded with hydraulic fluid from lines 22, 23. The control 24 sits in a block.

The hydraulic working cylinders 25, 26, in which the drive pistons 27, 28 move alternatingly back and forth, drive the pistons 15, 16 through their piston rods. The loading occurs on the full piston side from the lines 29, 30, which are switched by the control 24. The synchronization of the pistons 27, 28 is assured by the displacement circuit 31 that is connected to the working cylinders 25, 26 on the piston rod side. Thereby, the displacement circuit 31 contains the hydraulic working substance, that in each case has been replaced in the respective cylinder 25, 26 by an advancing drive piston 27, 28, and transfers it to the adjacent piston.

The two lines 32, 33 start at the displacement circuit, and load the cylinder cavities 35, 36, separated by a linear piston, with hydraulic pressure medium, that is added to the amount replaced in each case. The piston rod 37 that is connected with the displacing or linear piston 34, assures equal volume cylinder cavities 35, 36, so that the back-and-forth movement of the displacing piston 34 in direction of the arrow 13 is assured in both directions.

The piston rod 37 in the first example of execution according to FIG. 1 is connected with a long rocker 100, to which at the linkage points 400, 401, 402 crank rockers 390, 391, 392 are coupled. The crank rockers 390, 391, 392 are equipped with a frame-fixed hinge 420, 421, 422. Along the crank rockers 390–392, respectively, the slides 380, 381, 382 are movable, which are connected to the piston rods 430, 431, 432 of linear pistons 440, 441, 442. The linear pistons 440, 441, 442 are utilized for the feeding of various additives and dosing agents, such as, e.g., solidification accelerators or the like from the respective tanks 460, 461, 462. The corresponding feed cylinders 470, 471, 472 are connected with the tanks on both sides with line branches which are provided with check valves. Corresponding to them are branches with check valves of the feed lines 480, 481, 482, which in each case run to a distribution valve 490, 491, 492. The distribution valves 490–492, which are identical, are in the following only described on the basis of the distribution valve 490. It is on one side loaded with an adjustable spring 50 and on the other side loaded through a line 51, that always reflects the prevailing pressure in the piston cavities 52. 53 of the working cylinders 25, 26. Naturally, the distribution valves 491 and 492 are through the line 51 loaded with the prevailing pressure in the piston cavities 52, 53. Check valves 54, 55 in the branches of the lines 51 assure that the flow of hydraulic working substance from one to the other of the cylinder cavities 52, 53 is prevented.

The hydraulic pressure generator 73, for the hydraulic working substance 75 of the concrete pump 1 kept ready in a tank 74, precedes the control 24 that also influences a back flow control 76.

In the depicted position of the distribution valves 490, 491, 492, the additive transport occurs in each case from the tanks 460, 461, 462 through the cylinders 470, 471, 472 respectively back to the tanks 460, 461, 462, for which it is assumed that a total volume 56 is compressible in the concrete delivery cylinder 12. As soon as the concrete column 77 present in the delivery cylinder 12 has started to move, the pressure in cylinder cavity 52 increases to a point that it opens the check valve 54 and loads the distribution valves 490, 491, 492, whereby the springs 50 yield and open the path for the additional dosing agent in the lines 8, 81, 82. In the case shown, from the individual dosing devices 500, 501, 502, varying dosing agent is fed through the fittings or connections 7, 71, 72 of the spay nozzle 5 and is sprayed with the discharge air 6. Simultaneously, the concrete is transported through the connection 2 of the nozzle pipe 3.

In lines 82, 81, 8, closing devices in the form of valves 110, 111, 112 are provided, which can close off the individual feed lines. Furthermore, line 82 is connected with line 81 through a cross-over line 113, where the cross-over line 113 can be closed off by a valve 114. Line 8 is connected with line 81 through a cross-over line 115, which also can be closed off by a valve 116. Finally, lines 8 and 82 are connected with each other through a cross-over line 117, which also can be closed off by a valve 118. Through this arrangement it is feasible to transfer, according to requirements, additive through only one line. If, e.g., the dosing agent present in tank 460 is to be fed alone, and the dosing agents present in tanks 461 and 462 are to be fed together into the nozzle 5, e.g., valve 110 is to be closed while valves 111 and 112 are to be opened. Furthermore, valve 114 will be opened, while valves 116 and 118 will be closed. Thereby can the dosing agents from the dosing devices 501 and 502 already react with each other prior to entry into the nozzle.

The adjustment of the individual slides 380, 381, 382 controls the excursion of the crank rockers 390, 391, 392 and determines exclusively the corresponding amounts of dosing agent replaced by the linear pistons 440, 441, 442. Through resetting of the slides 380, 381, 382 with the aid of one spindle 590, 591, 592 each, this quantity can be changed and thereby adjusted to the concrete output quantity or quality desired in each particular case. The spindles 590, 591, 592 are in the case of the example fastened to the link points 420, 421, 422, so that in this way the dosing quantity of the individual dosing devices 500, 501, 502 may be metered in from a minimum value, i.e. zero, to a maximum predetermined value. Depending on the application case and desired concrete quality, it is, therefore, possible to add, e.g., dosing agent from the dosing device 500, while dosing agent from the dosing devices 501 and 502 is added only in a very small measure, if at all.

In the branch of the displacement circuit 31, in addition to the branches 32, 33, a close-off cock 73 is installed. In a closed, blocked condition the close-off clock 72 allows through the branches 32, 33 the propulsion of the displacement piston 34. In an opened condition the close off clock 72 close-circuits the branches 32, 33, preventing the build-up of pressure for the propulsion of the displacement piston, with the result that no transport of dosing agents occurs from the tanks 460, 461, 462.

Figure 2:
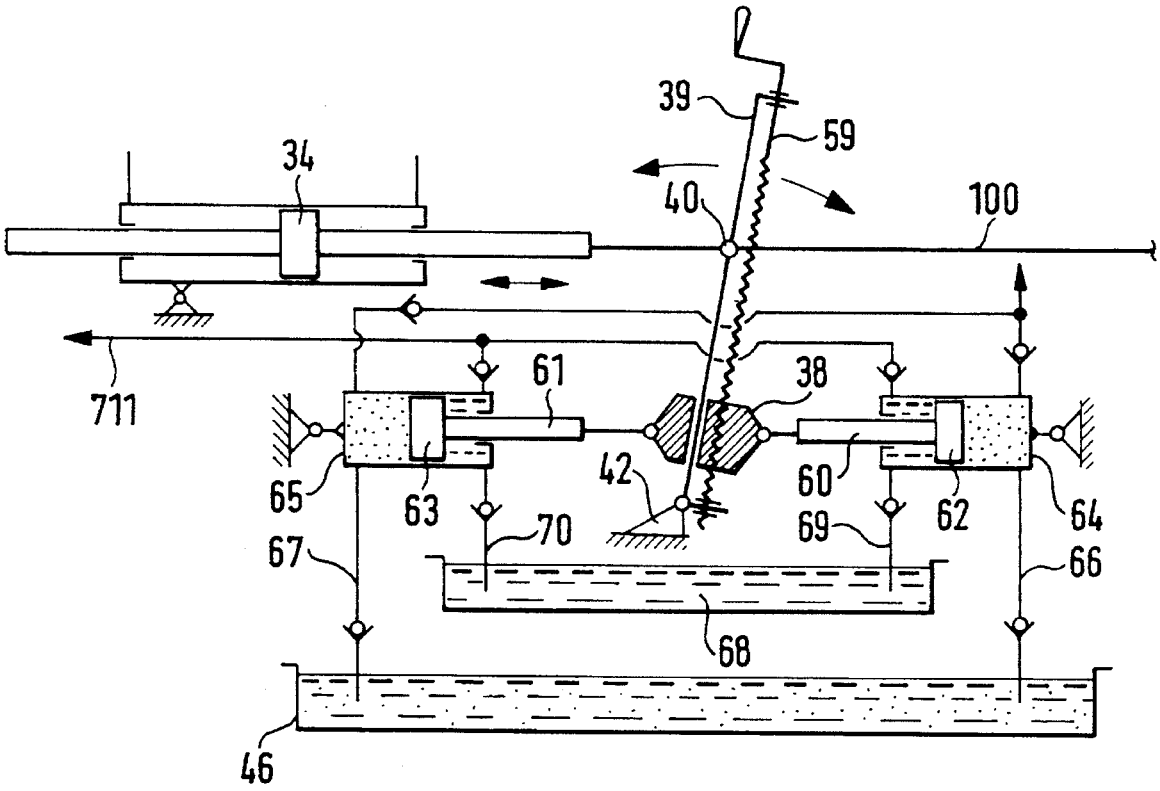
FIG. 2 is a schematically illustration of a second form of execution of the invention, in which only the dosing device is depicted.

In the form of execution according to FIG. 2, showing only one dosing device, one piston rod each 60, 61 is hinged at 38 to the crank rocker 39. The crank rocker 39 is coupled to the rocker 100. The piston rods 60, 61 are moved opposed to each other, so that the rocker is driven in accordance with the arrow. The metering pistons 62, 63, connected with the piston rods 60 and 61, are running in simply acting metering cylinders 64, 65 analog the conditions of arrangement of the linear pistons 440, 441, 442.

The piston rod sides of the cylinders 64, 65 are, however, loaded with water from a storage tank 68, through line branches 69 and 70 which are protected by check valves. In the piston return, line branches of a waste water line 711 are filled, while check valves in them take care that no waste water can be sucked in. This prevents incrustation of additives with a tendency for such. In the case of example, the crank rocker 39 is hinged at the link point 42. Also connected to the rocker at 40 is the linear piston 34 that drives it. Along the crank rocker 39, the slide 38 is movable through the spindle 59. In this way, the displacement of the metering pistons 62 and 63 can be run to zero, if the radius between slide 38 and link point 42 equals zero. The depicted form of execution has only been shown on the basis of one dosing device. It is understood that this form of execution is possible for each of the additional dosing devices 501, 502.

Figure 3:
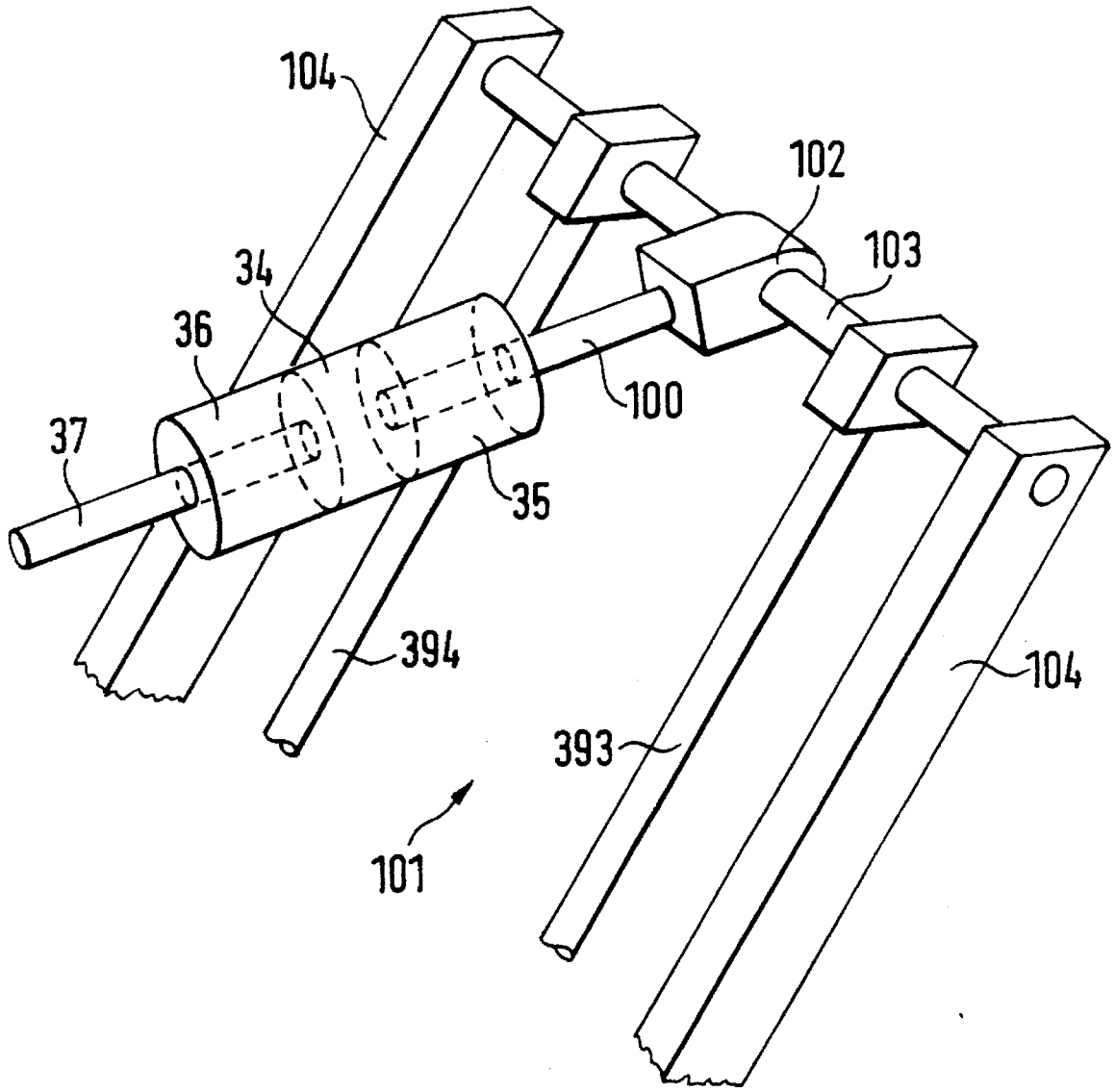
FIG. 3 is a perspective view of a form of execution of a switch with crank rockers according to the invention.

FIG. 3 shows a particular form of execution of a switch 101 that follows rocker 100. Rocker 100 and switch 101 are connected by a connecting element 102, that is fastened through a pivoting linkage on a cross rod 103. The cross rod 103 that runs essentially horizontal, is limited at its ends by two frame parts 104 which run approximately vertical. However, the cross rod 103 accepts also crank rockers, here labeled 393 and 394. The crank rockers 393, 394 run approximately parallel to the frame members 104. Instead of the depicted form of execution with two crank rockers, obviously also a larger number of crank rockers are possible. This depends on the number of the desired and necessary dosing devices. Along the depicted crank rockers 393, 394 are movable slides, not shown. At its lower end, the switch 101 is attached through a pivoting joint, as indicated in FIG. 1 and FIG. 2 by 42, 420, 421, and 422.

What is claimed is:

1. An apparatus for the pneumatic delivery of concrete that is hydromechanically transported in an enclosed stream comprising:

a concrete pump for hydromechanically transporting the stream of concrete, the pump including a hydraulic drive having at least two working cylinders with opposed reciprocating pistons, a hydraulic medium for driving the reciprocating pistons, and a displacement circuit for synchronizing the movement of the reciprocating pistons;

a solidification accelerator dosing device having a linear piston drive operatively connected to the displacement circuit to provide hydraulically working medium from the pump to reciprocally operate the linear piston drive, a linear piston pump connected to the linear piston drive with a slide, and a discharge line having a distribution valve for the redirection of the solidification accelerator flow into an additive tank or into an additive discharge line which is loaded with the pressure of the hydraulic medium prevailing in the working cylinders; and characterized by at least one additional additive dosing device with a linear piston pump connected to the linear piston drive, wherein each additional dosing device includes a discharge line having a distribution valve for the redirection of the dosing agent into a dosing agent tank or into a dosing agent feed line which is loaded with the prevailing pressure of the hydraulic medium in the working cylinders.

2. The apparatus according to claim 1, wherein each dosing device is connected through a separate line with a spray nozzle.

3. The apparatus according to claim 1, wherein the discharge lines of the dosing devices are connected with each other.

4. The apparatus according to claim 1, wherein a rocker is coupled to a piston of the linear piston drive, the additional dosing device being connected to the rocker.

5. The apparatus according to claim 4, wherein a piston of each linear piston pump of the additional dosing devices is connected through a pivot with a crank rocker that is again connected to the rocker.

6. The apparatus according to claim 5, wherein a slide is movable along the crank rocker of the additional dosing device that is connected to the linear piston pump of the additional dosing device.

7. The apparatus according to claim 6, further comprising a guide for the slide, the guide having one end connected to a fix-linked link point of the crank rocker.

8. The apparatus according to claim 4, wherein the rocker is constructed as an elongated rod.

9. The apparatus according to claim 5, wherein the crank rocker of the additional dosing device is constructed in the form of a common switch.

10. An apparatus for pneumatically discharging concrete fed hydromechanically in a dense stream, the apparatus comprising:

a concrete pump for hydromechanically feeding the dense stream of concrete, the pump including a hydraulic drive having at least two working cylinders with opposed reciprocating pistons therein, a hydraulic working medium for driving the reciprocating pistons, and a displacement circuit for synchronizing the movement of the reciprocating pistons;

an additive dosing device operatively connected with the hydraulic drive of the concrete pump, the additive dosing device including a linear reciprocating piston drive connected to the displacement circuit to provide hydraulic working medium from the concrete pump to reciprocally operate the linear piston drive, a linear piston pump connected to the linear piston drive, a slide positioned at the connection of the linear piston pump and the linear piston drive, and a discharge line having a distribution valve for the redirection of the additive dosing device into an additive tank or into an additive discharge line, wherein the discharge line is loaded with the pressure of hydraulic working medium in the working cylinders; and at least one additional additive dosing device connected to the linear piston drive, each additional additive dosing device having a linear piston pump and a discharge line having a distribution valve therein for the redirection of the dosing agent into a dosing agent tank or into a dosing agent feed line, the distribution line being loaded with the pressure of hydraulic working medium in the working cylinders.

11. The apparatus according to claim 10, wherein each dosing device is connected through a separate line with a spray nozzle.

12. The apparatus according to claim 10, wherein the discharge lines of the dosing devices are connected with each other.

13. The apparatus according to claim 10, wherein a rocker is coupled to a piston of the linear piston drive, the additional additive dosing device being connected to the rocker.

14. The apparatus according to claim 13, wherein a piston of each linear piston of each linear piston pump of the additional additive dosing devices is connected through a pivot with a crank rocker that is again connected to the rocker.

15. The apparatus according to claim 14, wherein a slide is movable along the crank rocker of the additional additive dosing device that is connected to the linear piston pump of the additional additive dosing device.

16. The apparatus according to claim 15, further comprising a guide for the slide, the guide having one end connected to a fix-linked link point of the crank rocker.

17. The apparatus according to claim 13, wherein the rocker is constructed as an elongated rod.

18. The apparatus according to claim 14, wherein the crank rocker of the additional additive dosing device is constructed in the form of a common switch.

19. The apparatus according to claim 10, wherein the volume of hydraulic working medium absorbed by the reciprocating piston drive in both directions corresponds to the amount of hydraulic working medium displaced from one cylinder by the advancing piston, the absorbed amount being added in both directions to the other cylinder.

20. The apparatus according to claim 10, wherein the displacement circuit reciprocally conducts the working medium displaced by an advancing piston of one cylinder and discharging the working medium to the other cylinder.

* * * * *